US012352062B2

(12) United States Patent
Namespetra et al.

(10) Patent No.: US 12,352,062 B2
(45) Date of Patent: Jul. 8, 2025

(54) COLLAPSIBLE TOILET ENCLOSURE

(71) Applicant: ADVANTAGE ENGINEERING INC., Oldcastle (CA)

(72) Inventors: Justin L. Namespetra, Essex (CA); Jamie O'Neil, Woodslee (CA); Steve L. Hengsperger, Tecumseh (CA)

(73) Assignee: ADVANTAGE ENGINEERING INC., Oldcastle (CA)

( * ) Notice: Subject to any disclaimer, the term of this patent is extended or adjusted under 35 U.S.C. 154(b) by 248 days.

(21) Appl. No.: 17/429,394

(22) PCT Filed: Feb. 12, 2020

(86) PCT No.: PCT/CA2020/050186
§ 371 (c)(1),
(2) Date: Aug. 9, 2021

(87) PCT Pub. No.: WO2020/163954
PCT Pub. Date: Aug. 20, 2020

(65) Prior Publication Data

US 2022/0145650 A1 May 12, 2022

Related U.S. Application Data

(60) Provisional application No. 62/806,158, filed on Feb. 15, 2019.

(51) Int. Cl.
*E04H 1/12* (2006.01)
*A47K 3/32* (2006.01)
(Continued)

(52) U.S. Cl.
CPC ..... *E04H 1/1216* (2013.01); *A47K 3/325* (2013.01); *E04B 1/343* (2013.01); *E04H 15/46* (2013.01); *E04H 15/48* (2013.01)

(58) Field of Classification Search
CPC ... E04H 1/1216; E04H 1/1244; E04H 1/1266; E04H 15/003; E04H 15/46; E04H 15/48; A47K 3/325; E04B 1/343
(Continued)

(56) References Cited

U.S. PATENT DOCUMENTS 1,912,425 A 6/1933 Baumer
2,538,736 A * 1/1951 Spencer ..... B60P 3/34 296/171
(Continued)

FOREIGN PATENT DOCUMENTS

CN 102828552 A 12/2012
CN 107119924 A 9/2017
(Continued)

OTHER PUBLICATIONS

Chinese Patent Application No. 202080014588.X, office Action dated Jul. 21, 2022—English Translation available.
(Continued)

*Primary Examiner* — Brent W Herring
(74) *Attorney, Agent, or Firm* — Borden Ladner Gervais LLP; Michael Damiani

(57) ABSTRACT

The present disclosure provides a collapsible toilet enclosure. The collapsible toilet enclosure comprises: a base portion; an upper frame portion movably engaged to the base portion and movable between an extended position and a collapsed position; and at least one coupling structure comprising: a linker, a first connecting portion, and a second connecting portion, where the first connecting portion is engaged with the base portion and the second connecting portion is engaged with the upper frame portion, and the linker is engagable with the first and second connecting portions when the upper frame portion is in the extended position, and where the at least one coupling structure is
(Continued)

adjustable to change the distance between the base portion and the upper frame portion when the linker is engaged with the first and second connecting portions.

18 Claims, 12 Drawing Sheets

(51) Int. Cl.
*E04B 1/343* (2006.01)
*E04H 15/46* (2006.01)
*E04H 15/48* (2006.01)

(58) Field of Classification Search
USPC ..... 52/67, 79.5; 4/449, 312, 599, 664; 135/902, 139
See application file for complete search history.

(56) References Cited

U.S. PATENT DOCUMENTS 3,351,078 A * 11/1967 Kleiman ..... B60P 3/38 135/153
4,277,919 A * 7/1981 Artweger ..... B60P 3/34 52/121
4,934,396 A 6/1990 Vitta
5,029,348 A 7/1991 Boren
5,379,466 A 1/1995 Davies
5,829,205 A 11/1998 Clark et al.
6,152,520 A * 11/2000 Gardner ..... B60P 3/341 52/79.5
6,467,231 B1 * 10/2002 Carlinsky ..... E04H 9/14 52/126.6
8,869,465 B2 * 10/2014 McDougall ..... E04B 7/04 52/79.5
9,289,101 B2 * 3/2016 Weir ..... A47K 11/04
9,416,527 B2 * 8/2016 McInerney ..... E04H 1/1205
9,622,597 B2 4/2017 White
10,422,154 B2 9/2019 Farris et al.
10,724,259 B2 * 7/2020 Schimmel ..... A47K 3/325
2013/0055499 A1 3/2013 Miguel Serda
2014/0345039 A1 11/2014 Weir
2016/0053477 A1 * 2/2016 McInerney ..... E04B 1/343 52/745.14
2016/0143492 A1 * 5/2016 Moise ..... G06F 13/4022 4/476

FOREIGN PATENT DOCUMENTS

DE 202005009772 U1 9/2005
WO 2006029417 A1 3/2006
ZA 200409806 B 5/2006

OTHER PUBLICATIONS

European Patent Application No. 20756079.8 , Extended European Search Report dated Sep. 21, 2022.
International Patent Application No. PCT/CA2020/050186, International Search Report and Written Opinion dated Apr. 24, 2020.
International Patent Application No. PCT/CA2020/050186, International Preliminary Report on Patentability dated Aug. 26, 2021.
European Patent Application No. 20756079.8, European Office Action dated Aug. 20, 2024.
Mexican Patent Application No. MX/a/2021/009711, Office Action dated Aug. 21, 2024—English Translation Not Available.
Canadian Patent Application No. 3137639 Office Action dated Mar. 13, 2025.
Mexican Patent Application No. MX/a/2021/009711, Office Action dated Nov. 29, 2024—English Translation Available.
Mexican Patent Application No. MX/a/2021/009711, Office Action dated Aug. 21, 2024—English Translation Available.
European Patent Application No. 20 756 079.8 Office Action dated Mar. 18, 2025.

* cited by examiner

COLLAPSIBLE TOILET ENCLOSURE

CROSS-REFERENCE TO RELATED APPLICATIONS

This application claims the benefit of priority of U.S. Provisional Patent Application No. 62/806,158 filed Feb. 15, 2019, which is hereby incorporated by reference.

FIELD

The present disclosure relates to portable, collapsible toilet enclosures.

BACKGROUND

The following paragraphs are not an admission that anything discussed in them is prior art or part of the knowledge of persons skilled in the art.

Standard portable toilet enclosures consist of one or more pieces fixed together to create a non-collapsible housing surrounding a toilet, with a door opening through which a user can access the toilet. An example of such a standard portable toilet enclosure is disclosed in U.S. Pat. No. 4,446,585.

The size, weight, and one-piece construction of standard portable toilet enclosures can make delivery, portability, and/or storage difficult. Attempts have been made to overcome the drawbacks associated with standard portable toilet enclosures by making collapsible toilet enclosures. Examples include the collapsible toilet enclosures disclosed in U.S. Pat. Nos. 5,671,487, 5,974,597, and 9,289,101.

INTRODUCTION

The following introduction is intended to introduce the reader to this specification but not to define any invention. One or more inventions may reside in a combination or sub-combination of the apparatus elements or method steps described below or in other parts of this document. The inventors do not waive or disclaim their rights to any invention or inventions disclosed in this specification merely by not describing such other invention or inventions in the claims.

Some collapsible toilet enclosures suffer from problems associated with their collapsibility, such as a lack of structural strength, and difficulty with set-up. These drawbacks have been overcome through the design of the collapsible toilet enclosure described in U.S. Pat. No. 9,289,101 where a base portion is pivotally connected to an upper frame portion. The upper frame portion is pivotable relative to the base portion between a collapsed position where the upper frame portion forms a lid for the base portion, and an extended position where the upper frame portion and a front wall of the base portion form a front wall of the toilet enclosure. The contents of U.S. Pat. No. 9,289,101 are incorporated herein by reference.

Although the collapsible toilet enclosure disclosed in U.S. Pat. No. 9,289,101 (the '901 patent) overcomes some drawbacks associated with previous collapsible toilet enclosures, the authors of the present disclosure have found that a pivotable connection between the base portion and the upper frame portion, when formed from conventional materials and in a conventional manufacturing process, results in a toilet enclosure that lacks sufficient structural strength for the toilet enclosure to remain substantially vertical and substantially square over the typical full length of time, and in the typical environmental conditions, that portable toilet enclosures are deployed. Portable toilet enclosures are conventionally made of lightweight and moldable materials, such as composite materials. Examples include plastic, for example polyethylene plastic, aluminum, and/or fiberglass. Portable toilet enclosures are typically deployed for at least a day, for example during a marathon or concert event, and sometimes for a week or multiple years, for example on construction sites. Portable toilet enclosures are typically deployed outdoors and experience fluctuations in heat, direct or indirect sunlight, rain, high winds, freezing temperature, or combinations thereof.

A collapsible toilet enclosure that does not remain substantially vertical and substantially square may result in, over time, a toilet enclosure with portions that are not aligned. A lack of alignment in portions of the toilet enclosure may lead to, for example, a door that no longer closes and locks, a toilet enclosure that can no longer fully collapse, which may cause stacking problems, or a combination thereof.

The authors of the present disclosure attempted to address the drawbacks associated with the collapsible toilet enclosure disclosed in the '901 patent by: strengthening the main hinge points and the base; adding a bar that engages the side walls of the base at one end and engages the upper portion at the other end, when the toilet is an extended position; having the side walls of the base engage the removable toilet tank to add rigidity to the base portion; adding lockable aluminum support arms to either side of the door; and extending a hinge pin of the toilet enclosure door to engage and lock into a portion of the roof of the toilet enclosure. However, the authors found that, because conventional and economically feasible manufacturing materials are not sufficiently rigid, the tested collapsible toilet enclosures remained unable to be substantially vertical and substantially square over typical lengths of deployment time, and in typical environmental conditions.

The authors recognized that the drawbacks associated with the collapsible toilet enclosure disclosed in the '901 patent could be addressed not by compensating for the lack of structural strength but by adjusting the dimensional relationship between the base portion and the upper frame portion in the field, compensating for dimensional changes produced over time. For example, a collapsible toilet enclosure having an adjustable joiner between the base portion and the upper frame portion, whose door no longer closes and locks because the collapsible toilet enclosure is no longer sufficiently square and sufficiently vertical, may be altered by adjusting the length of the joiner to sufficiently realign the door and door frame so that the door can be closed and locked.

In one aspect, the present disclosure provides a collapsible toilet enclosure comprising: a base portion; an upper frame portion movably engaged to the base portion and movable between an extended position and a collapsed position; and at least one coupling structure comprising: a linker, a first connecting portion, and a second connecting portion, wherein the first connecting portion is engaged with the base portion and the second connecting portion is engaged with the upper frame portion, and the linker is engagable with the first and second connecting portions when the upper frame portion is in the extended position, wherein the at least one coupling structure being adjustable to change the distance between the base portion and the upper frame portion when the linker is engaged with the first and second connecting portions.

The length of the linker may be adjustable to change the distance between the base portion and the upper frame portion. The linker may be an arm. The arm may comprise at least two nestable portions movable relative to each other to change the length of the arm. One of the nestable portions may define a channel and the other nestable portion may be slidably engagable within the channel along an axis of movement, and the arm may further comprise a threaded member to move the nestable portions relative to each other and to change the length of the arm. The threaded member may be engagable with the at least two nestable portions along the axis of movement, and rotation of the threaded member may move the nestable portions relative to each other.

The linker may be a cable. The cable may comprise at least two cable portions movable relative to each other to change the length of the cable. The linker may further comprise a cable tensioner couplable to the at least two cable portions to move the at least two cable portions relative to each other and to change the length of the cable.

The first connecting portion, the second connecting portion, or both may be adjustable to change the distance between the base portion and the upper frame portion.

The linker may be releasable from the first connecting portion, the second connecting portion, or both when the upper frame portion is in the collapsed position. The linker may be engagable with the first connecting portion at a first coupling point, and the first connecting portion may be adjustable to move the first coupling point relative to the base portion, may be engagable with the second connecting portion at a second coupling point, and the second connecting portion is adjustable to move the second coupling point relative to the upper frame portion, or both.

The first connecting portion may define a channel and the first coupling point may be slidably engagable within the channel along an axis of movement, and the first connecting portion may further comprise a threaded member to move the first coupling point relative to the base portion. The second connecting portion may define a channel and the second coupling point may be slidably engagable within the channel along an axis of movement, and the second connecting portion may further comprise a threaded member to move the second coupling point relative to the upper frame portion.

The threaded member may be engagable with the channel and the first connecting portion along the axis of movement, and rotation of the threaded member may move the first coupling point relative to the base portion.

The threaded member may be engagable with the channel and the second connecting portion along the axis of movement, and rotation of the threaded member may move the second coupling point relative to the upper frame portion.

The first connecting portion may be engagable with the base portion without forming a unity structure, the second connecting portion may be engagable with the upper frame portion without forming a unitary structure, or both.

The base portion may comprise a first doorframe portion, and the upper frame portion may comprise a second doorframe portion, and when the upper frame portion is in the extended position, the first doorframe portion and the second doorframe portion may align to form a doorframe, wherein the distance between the base portion and the upper frame portion may be the distance between a corner of the doorframe at the base portion and a corner of the doorframe at the upper frame portion that are adjacent to one another.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Figure 1A:
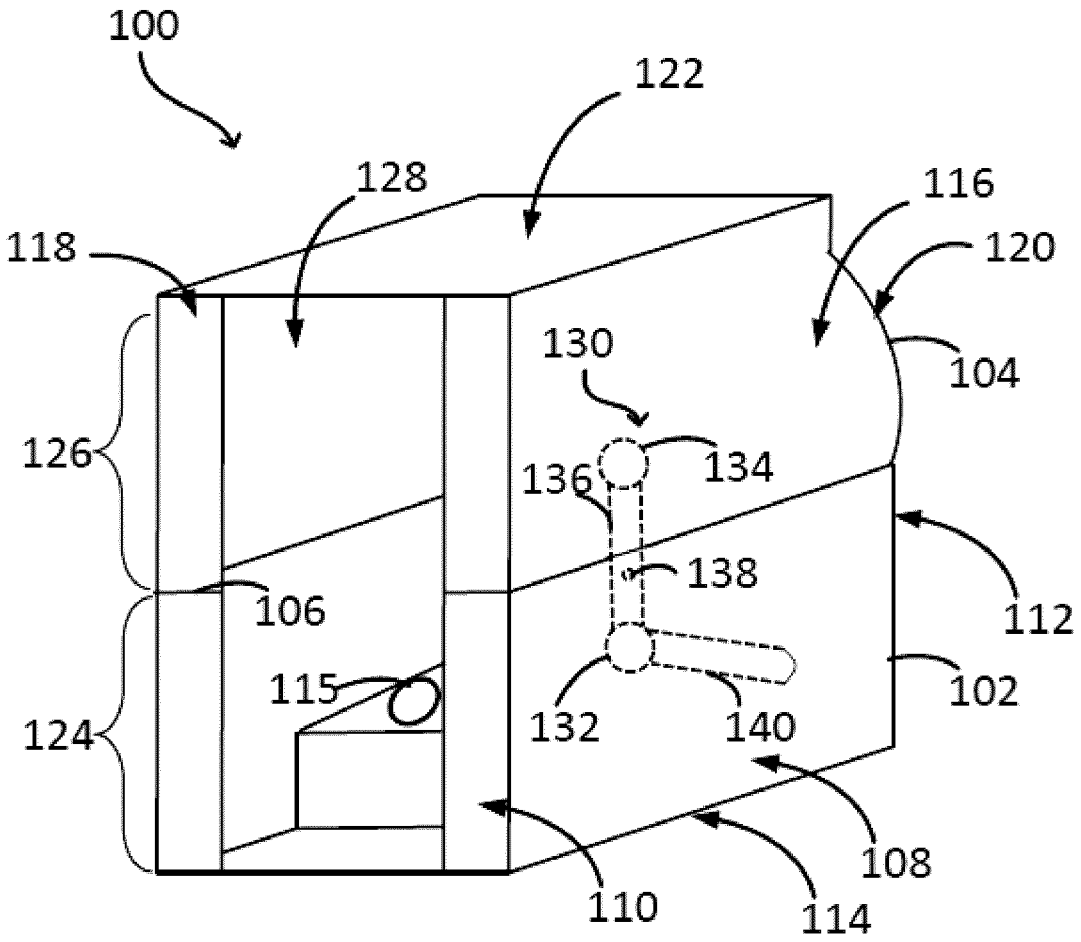
FIG. 1A-B is a front isometric view of an example of a collapsible toilet enclosure according to the present disclosure in an extended position (FIG. 1A) and a collapsed position (FIG. 1B).

Generally, the present disclosure provides a collapsible toilet enclosure that includes a base portion and an upper frame portion. The upper frame portion is movably engaged to the base portion and movable between an extended position and a collapsed position. The collapsible toilet enclosure also includes at least one coupling structure including a linker, a first connecting portion, and a second connecting portion. The first connecting portion is engaged with the base portion and the second connecting portion is engaged with the upper frame portion, and the linker is engagable with the first and second connecting portions when the upper frame portion is in the extended position. The at least one coupling structure is adjustable to change the distance between the base portion and the upper frame portion when the linker is engaged with the first and second connecting portions.

Collapsible toilet enclosures according to the present disclosure have a base portion and an upper frame portion movably engaged to the base portion by means of a movable connection. The movable connection may be any connector that joins the base portion and the upper frame portion and allows the base portion and the upper portion to move relative to one another between an extended position and a collapsed position. Examples of the movable connection include a pivotal connection and a telescopic connection.

An extended position is when the upper frame portion is substantially aligned with the base portion to form a doorframe. The doorframe allows a user to enter and access the inner space of the collapsible toilet enclosure. A collapsed position is any position in which the base portion and the upper frame portion are not in the extended position. In some examples according to the present disclosure, a collapsed position is when a portion of the upper frame portion and a portion of the base portion overlap so that they no longer align to form a doorframe, which may be desirable, for example, when moving, stacking, and/or storing the collapsible toilet enclosure.

Collapsible toilet enclosures according to the present disclosure have a coupling structure that is adjustable to change the distance between the base portion and the upper frame portion of the collapsible toilet enclosure. The coupling structure comprises a first connecting portion that is engaged with the base portion, a second connecting portion that is engaged with the upper frame portion, and a linker engagable with the first and second connecting portions. The coupling structure may be any structure that engages the base portion and the upper frame portion and is adjustable to change the distance between the base portion and the upper frame portion when the linker is engaged with the first and second connecting portions, while the collapsible toilet enclosure is in the extended position. The coupling structure may engage the collapsible toilet enclosure at any location provided that adjusting the coupling structure is capable of changing the distance between the base portion and the upper frame portion when the linker is engaged with the first and second connecting portions. The coupling structure may engage the collapsible toilet enclosure on the outside of the walls of the base portion and the upper frame portion of the enclosure, which may be preferable, for example when a user wishes to change the distance between the base portion and the upper frame portion without entering the toilet enclosure. Alternatively, the coupling structure may engage the collapsible toilet enclosure within the inner space of the enclosure, which may be preferable, for example when increasing protection against tampering with the adjustment. The coupling structure may engage the collapsible toilet enclosure at or near the movable connection, for example when increasing the strength of the coupling structure and/or decreasing the stress on the coupling structure is desirable.

The linker may remain engaged with the first and the second connecting portions when the upper frame portion of a collapsible toilet enclosure is in a collapsed position. In some examples according to the present disclosure, the first and/or second connection portions rotationally engage the base portion and/or the upper frame portion, and when the upper frame portion is moved between an extended position and a collapsed position, the first and/or second connecting portions rotate about their rotational engagement point and allow the linker to remain engaged with the first and second connecting portions. Alternatively, the linker may be releasable from the first connecting portion, the seconding connecting portion, or both, when the upper frame portion is in a collapsed position, for example when it is desirable to: 1) more easily replace faulty linkers; 2) more easily disassemble the collapsible toilet enclosure for storage and/or travel; or 3) a combination thereof, compared to collapsible toilet enclosure where the linker is not releasable when in a collapsed position.

Changing the distance between the base portion and the upper frame portion refers to any distance change between the base portion and the upper frame portion that can transform a collapsible toilet enclosure from (a) not substantially vertical and not substantially square to (b) substantially vertical and substantially square. Substantially vertical refers to any angle between a vertical plane of the collapsible toilet enclosure that is perpendicular to the plane along the face of the doorframe and a horizontal plane along the base floor of the collapsible toilet enclosure that allows the door to sufficiently align with the door frame so that the door can close and lock when the collapsible toilet enclosure is in an extended position. In some examples according to the present disclosure, the vertical plane of the collapsible toilet may be from about 70 degrees to about 110 degrees from the horizontal plane, for example, about 70 degrees; about 75 degrees; about 80 degrees; about 85 degrees; about 88 degrees; about 89 degrees; about 90 degrees; about 91 degrees; about 92 degrees; about 95 degrees; about 100 degrees; about 105 degrees; about 110 degrees; or the vertical plane is from any one of the degrees listed above to any other of the degrees listed above. In some preferred examples, the vertical plane is about 90 degrees from the horizontal plane.

Substantially square refers to any angle between a vertical plane of the collapsible toilet enclosure that is perpendicular to the plane along the face of the doorframe and a horizontal plane of the collapsible toilet enclosure that allows the door to sufficiently align with the door frame so that the door can close and lock when the collapsible toilet enclosure is in an extended position. In some examples according to the present disclosure, the vertical plane of the collapsible toilet enclosure may be from about 70 degrees to about 110 degrees from the horizontal plane, for example, about 70 degrees; about 75 degrees; about 80 degrees; about 85 degrees; about 88 degrees; about 89 degrees; about 90 degrees; about 91 degrees; about 92 degrees; about 95 degrees; about 100 degrees; about 105 degrees; about 110 degrees; or the vertical plane is from any one of the degrees listed above to any other of the degrees listed above. In some preferred examples, the vertical plane is about 90 degrees from the horizontal plane of the collapsible toilet enclosure.

The distance change may be measured between any portion of the upper frame portion and any portion of the base portion. In some examples, the distance between the base portion and the upper frame portion is the distance between a corner of the doorframe at the base portion and a corner of the doorframe at the upper frame portion that are adjacent to one another when the upper frame portion is in the extended position. The change in distance may be any distance that can transform a collapsible toilet enclosure from (a) not substantially vertical and not substantially square to (b) substantially vertical and substantially square. In some examples, the distance change is from about 1 mm to about 30 mm, for example, about 1 mm, about 2 mm; about 3 mm; about 4 mm; about 5 mm; about 6 mm; about 7 mm; about 8 mm; about 9 mm; about 10 mm; about 15 mm; about 20 mm; about 25 mm; about 30 mm; or the distance change is from any one of the distances above to any other of the distances above.

The number of coupling structures per collapsible toilet enclosure may vary provided that the coupling structure(s) is capable of transforming a collapsible toilet enclosure from (a) not substantially vertical and not substantially square to (b) substantially vertical and substantially square. In some preferred examples, the collapsible toilet enclosure comprises at least two coupling structures, one of the at least two coupling structures on one side of a median plane of the doorframe perpendicular to the plane along the face of the doorframe, and another of the at least two coupling structures on the opposite side of the median plane. The shape of the coupling structure may vary provided that the coupling structure is adjustable and capable of changing the distance between the base portion and the upper frame portion when the linker is engaged with the first and second connecting portions while the upper frame portion of the collapsible toilet enclosure is in the extended position. In some examples according to the present disclosure, the linker has an approximately straight shape, for example when a stronger linker is desirable. In other examples according to the present disclosure, the linker may comprise one or more bends, for example to allow more efficient packaging of the toilet enclosure. In some examples according to the present disclosure, the shape of the linker may be fluid and change during: adjustment, when the upper frame is moved into a collapsed position, or a combination thereof.

The change in distance may be achieved by: (1) adjusting the absolute length of the linker; (2) adjusting the effective length of the linker; or (3) a combination thereof, when the linker is engaged with the first and second connecting portions when the upper frame portion is in the extended position. It should be understood that changing the effective length of a linker refers to changing the distance between the base portion and the upper frame portion, even if the absolute length of the linker does not change.

Adjusting the absolute length of the linker may be achieved using any configuration that is capable of moving portions of the linker between the first and second connecting portions of the coupling structure while the linker is engaged with the first and second connecting portions when the upper frame portion is in the extended position. In some examples according to the present disclosure, the linker may comprise at least two portions that are movable relative to each other to change the absolute length of the linker.

Adjusting the effective length of the linker may be achieved using any configuration that is capable of changing the distance between the base portion and the upper frame portion when the linker is engaged with the first and second connecting portions of the coupling structure when the upper portion is in the extended position, without adjusting the absolute length of the linker structure. In some examples according to the present disclosure, the linker may engage the first and/or second connecting portions at first and/or second coupling points, and moving the first and/or second coupling points may change the distance between the base portion and the upper frame portion of the collapsible toilet enclosure without adjusting the absolute length of the linker. The linker may engage the first and/or second connecting portions by any configuration provided that moving the first and/or second coupling point is capable of changing the distance between the base portion and the upper frame portion of the collapsible toilet enclosure when the upper frame portion is in the extended position. In some examples according to the present disclosure, the linker engages the first and/or second connecting portions by forming a unitary structure with the first and/or second connecting portions. Alternatively, the linker engages the first and/or second connecting portions without forming a unitary structure, for example, by slidable engagement, screw thread engagement, frictional engagement, notching engagement, or hook-and-loop engagement. Unitary structure refers to a connection between the linker and the first and/or second coupling portion that disallows the linker and the first and/or second coupling portion to move relative to one another, for example, the linker and the first and/or second coupling structure move as a single entity.

Optionally, the linker may further comprise an adjusting mechanism to selectively change the distance between the base portion and upper frame portion when the linker is engaged with the first and second connecting portion. Any adjusting mechanism may be used provided that the adjusting mechanism is capable of engaging and adjusting the coupling structure to change the distance between the base portion and the upper frame portion. The adjusting mechanism may engage the coupling structure at the first connecting portion, the second connecting portion, the linker, or a combination thereof.

Optionally, the linker may further comprise a locking mechanism to lock and impede a change in distance between the base portion and upper frame portion following adjustment. Any locking mechanism may be used provided that the locking mechanism is capable of engaging and securing the coupling structure to secure the absolute and/or effective length of the linker. The locking mechanism may engage the coupling structure at the first connecting portion, the second connecting portion, the linker, or a combination thereof. In some examples according to the present disclosure, the locking mechanism may also be the adjusting mechanism, and vice versa.

Figure 1B:
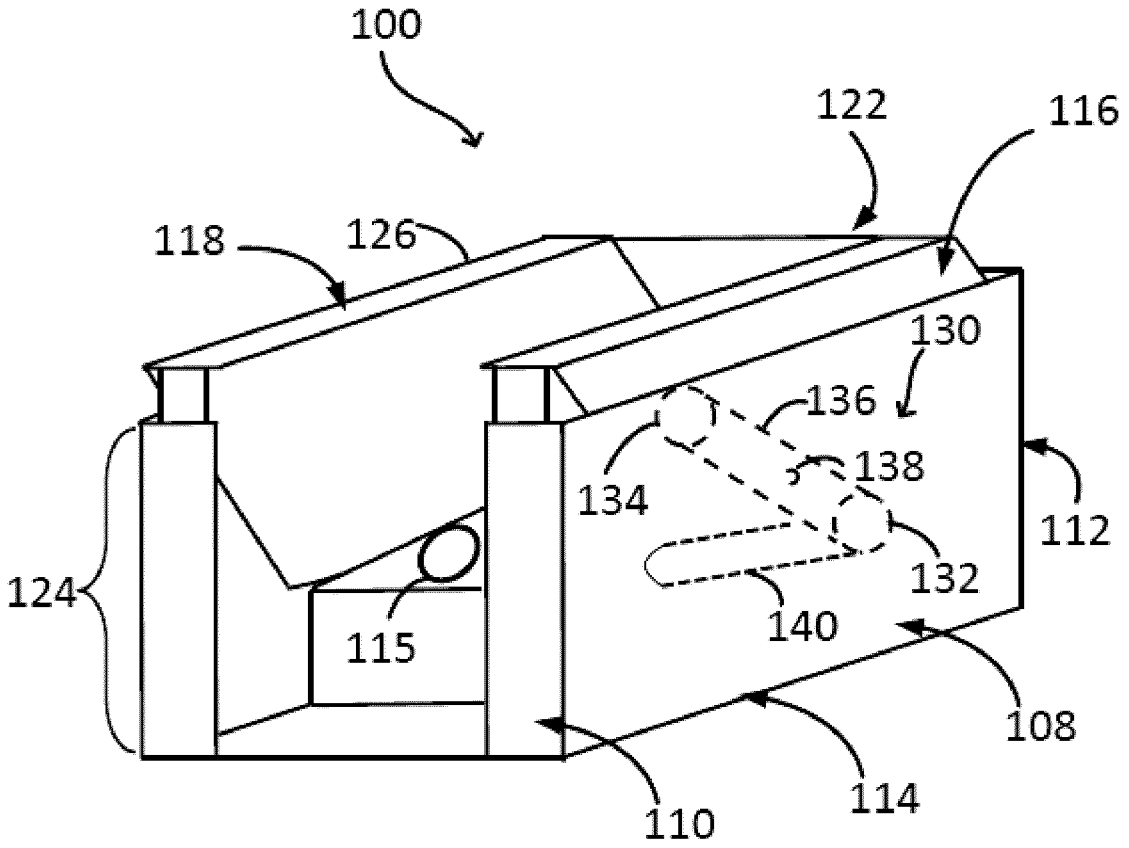

An example of a collapsible toilet enclosure according to the present disclosure is illustrated in FIG. 1A-B. The collapsible toilet enclosure 100 comprises a base portion 102 and an upper frame portion 104 movably engaged to the base portion 102 by means of a pivotal connection 106. The base portion 102 comprises sidewalls 108, a front wall 110, a back wall 112, and a base floor 114 forming an inner space containing a toilet 115. The upper frame portion 104 comprises sidewalls 116, a front wall 118, a back wall 120, and a roof 122 forming an inner space. The upper frame portion 104 is shown in the extended position where the front wall 110 of the base portion 102 forms a first doorframe portion 124 and the front wall 118 of the upper frame portion 104 forms a second doorframe portion 126, and the first doorframe portion 124 and the second doorframe portion 126 are aligned to form a doorframe 128. The collapsible toilet enclosure may comprise a door (not shown) pivotally mounted on the doorframe 128 to allow the doorframe to swing between open and closed positions when the upper frame portion is in the extended position. The door may be lockable in a closed position. FIG. 1B illustrates the collapsible toilet enclosure 100 in a collapsed position.

The collapsible toilet enclosure 100 comprises a coupling structure 130 comprising a first connecting portion 132 that is engaged with the base portion 102, a second connecting portion 134 that is engaged with the upper frame portion 104, and a linker 136 engaged with the first and second connecting portions 132, 134. The coupling structure 130 engages the inside of the side wall 108 of the base portion 102 and the inside of the side wall 116 of the upper frame portion 104. However, as will be further described in the examples below, the coupling structure may engage the base portion and the upper frame portion on front walls, back walls the roof, or a combination thereof. The coupling structure 130 is adjustable to change the distance between the base portion 102 and the upper frame portion 104 when the linker is engaged with the first and second connecting portions 132, 134.

The first connecting portion 132 is secured against the sidewall 108 of the base portion 102 by a lock pin 138 when the upper frame portion 104 is in the extended position, and the second connecting portion 134 is rotationally engaged with the upper frame portion 104. In use, when a user wishes to move the upper frame portion 104 into a collapsed position, the lock pin 138 is disengaged allowing the first connecting portion 132 to slide along channel 140 and the second connecting portion 134 to rotate about its rotational engagement point with the upper frame portion 104.

Figure 2:
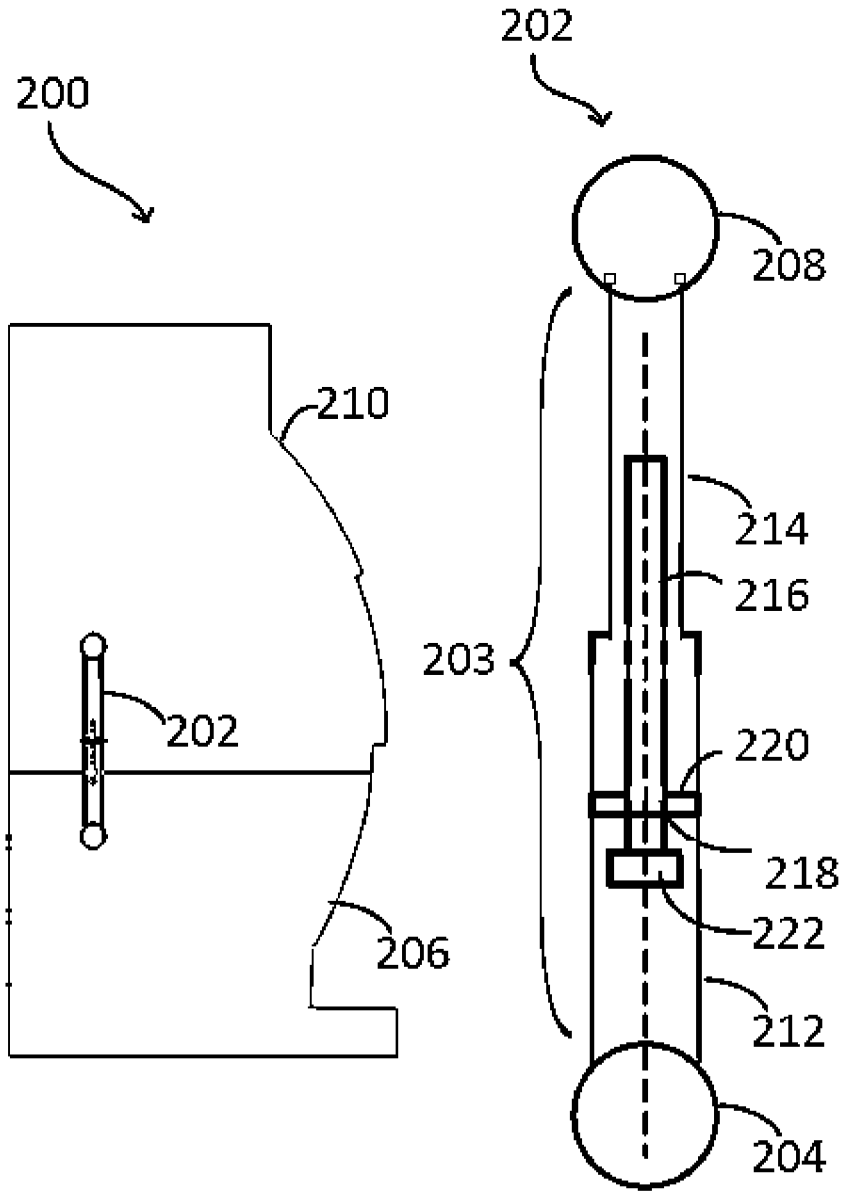
FIG. 2 is a side view of another example of a collapsible toilet enclosure according to the present disclosure showing an enlarged cross-sectional view of the coupling structure.

FIG. 2 illustrates an example of a collapsible toilet enclosure according to the present disclosure where the absolute length of the linker is adjustable to change the distance between the base portion and the upper frame portion when the linker is engaged with the first and second connecting portions. The collapsible toilet enclosure 200 comprises a base portion 206 and an upper frame portion 210 pivotally connected to the base portion 206 and in the extended position. The collapsible toilet enclosure 200 further comprises a coupling structure 202, which comprises a linker 203 and a first connecting portion 204 engaged with the base portion 206 and a second connecting portion 208 engaged with the upper frame portion 210. The linker 203 comprises a first nestable portion 212 defining a channel and a second nestable portion 214 slidably engagable within the channel along an axis of movement (dotted line) to change the absolute length of the linker 203.

The collapsible toilet enclosure 200 further comprises an adjusting mechanism to selectively move the first and second nestable portions 212, 214 relative to each other. The second nestable portion 214 comprises a threaded member 216, about parallel to the axis of movement, and engageable with the first nestable portion 212 through an aperture 218 formed by a wall 220 that is fixed to the first nestable portion 212 and located about perpendicular to the axis of movement. The threaded member 216 is securable to the first nestable portion 212 by a nut 222 engaged with the threaded end of the threaded member 216 on the side of the wall 220 opposite the second nestable portion 216. In use, a user may rotate the nut to move the nestable portions 214, 216 relative to each other.

Figure 3:
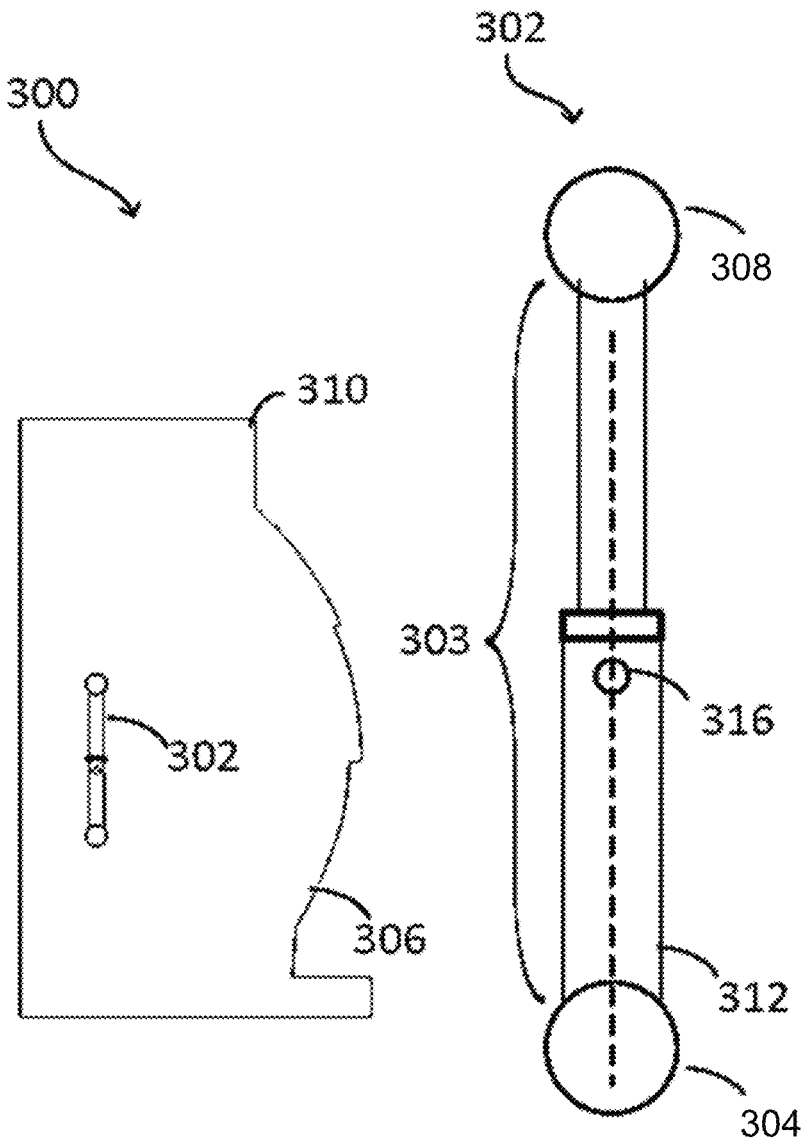
FIG. 3 is a side view of another example of a collapsible toilet enclosure according to the present disclosure showing an enlarged side view of the coupling structure.

FIG. 3 illustrates another example of a collapsible toilet enclosure according to the present disclosure where the absolute length of the linker is adjustable to change the distance between the base portion and the upper frame portion when the linker is engaged with the first and second connecting portions. The collapsible toilet enclosure 300 comprises a base portion 306 and an upper frame portion 310 pivotally connected to the base portion 306 and in the extended position. The collapsible toilet enclosure 300 further comprises a coupling structure 302, which comprises a linker 303 and a first connecting portion 304 engaged with the base portion 306 and a second connecting portion 308 engaged with the upper frame portion 310. The linker 303 comprises a first nestable portion 312 defining a channel and a second nestable portion 314 slidably engagable within the channel along an axis of movement (dotted line) to change the absolute length of the linker 303.

The collapsible toilet enclosure 300 further comprises a locking mechanism to secure the absolute length of the linker 303 following adjustment. The walls of the first and second nestable portions 312, 314 form apertures along a plane that is about perpendicular to the axis of movement. When the apertures are aligned, a bolt 316 is engagable with the first and second nestable portions 312, 314 through the aligned apertures to secure the absolute length of the linker 303.

Figure 4:
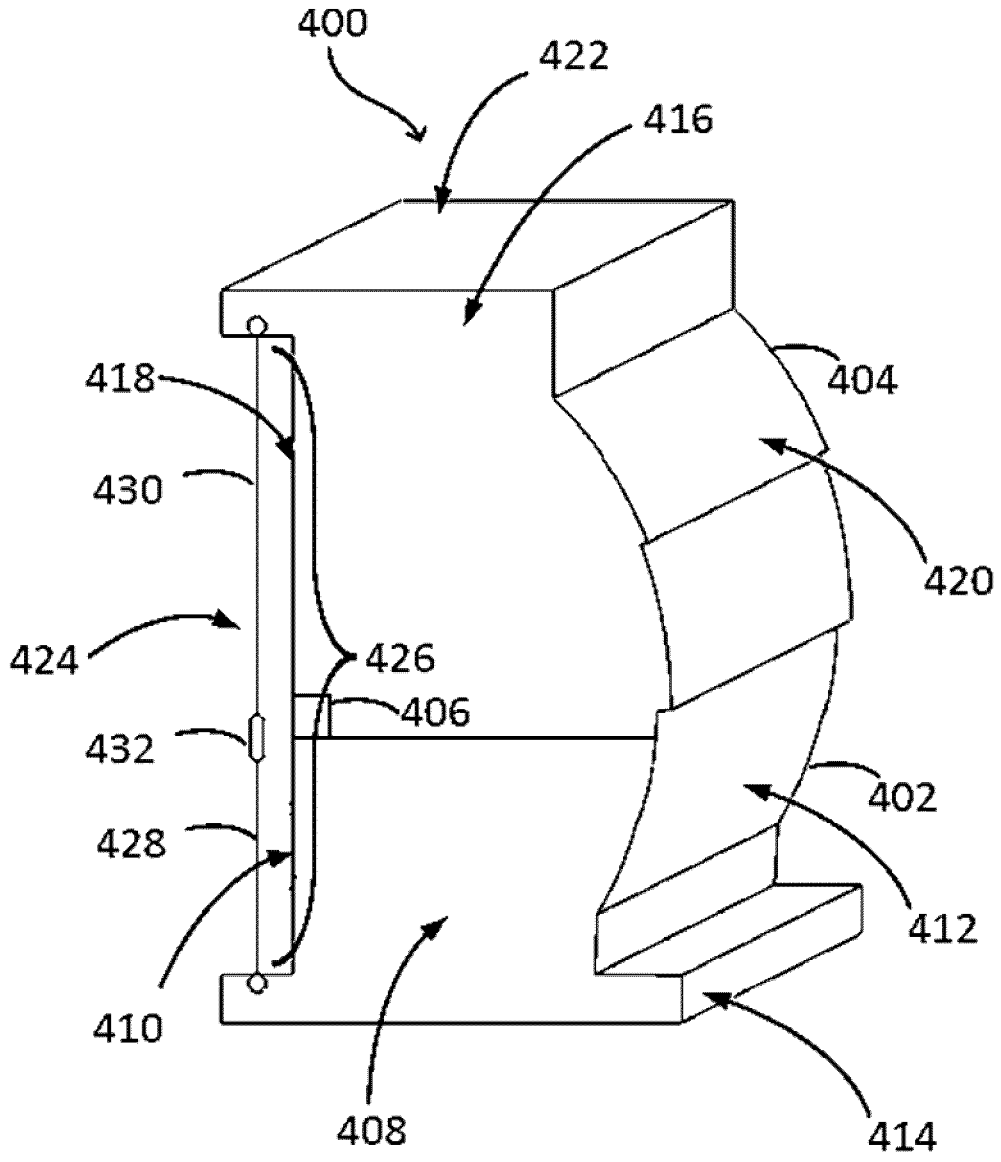
FIG. 4 is a back isometric view of another example of a collapsible toilet enclosure according to the present disclosure in an extended position.

FIG. 4 illustrates yet another example of a collapsible toilet enclosure according to the present disclosure where the absolute length of the linker is adjustable to change the distance between the base portion and the upper frame portion when the linker is engaged with the first and second connecting portions. The collapsible toilet enclosure 400 comprises a base portion 402 and an upper frame portion 404 movably engaged to the base portion 402 by means of a pivotal connection 406. The base portion 402 comprises sidewalls 408, a front wall 410, a back wall 412, and a base 414. The upper frame portion 404 comprises sidewalls 416, a front wall 418, a back wall 420, and a roof 422. The collapsible toilet enclosure 400 also comprises a coupling structure 424 comprising a linker 426. The linker 426 comprises a first cable portion 428 and a second cable portion 430, where the first cable portion 428 is engaged with the base 414 of the base portion 402 and the second cable portion 430 is engaged with the roof 422 of the upper frame portion 404. The first cable portion 428 is connected to the second cable portion 430 through means of a cable tensioner 432, which is able to move the first and second cable portions 428, 430 relative to each other to change the absolute length of the linker 426.

Figure 5:
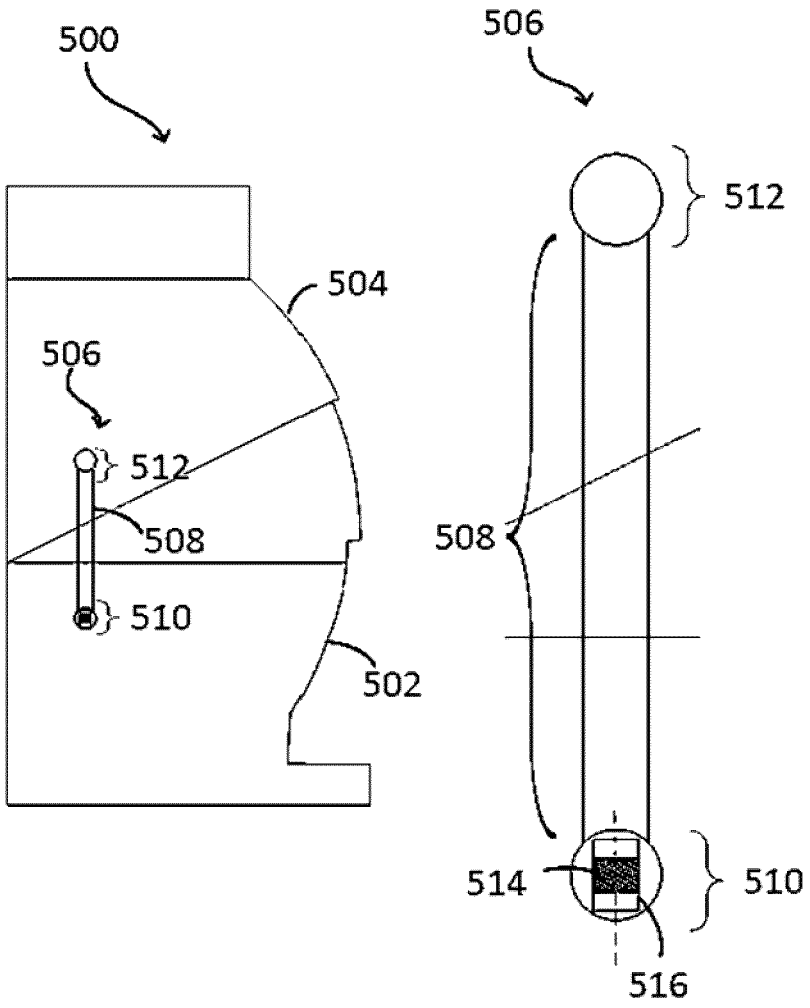
FIG. 5 is a side view of another example of a collapsible toilet enclosure according to the present disclosure showing an enlarged side view of the coupling structure.
Figure 6:
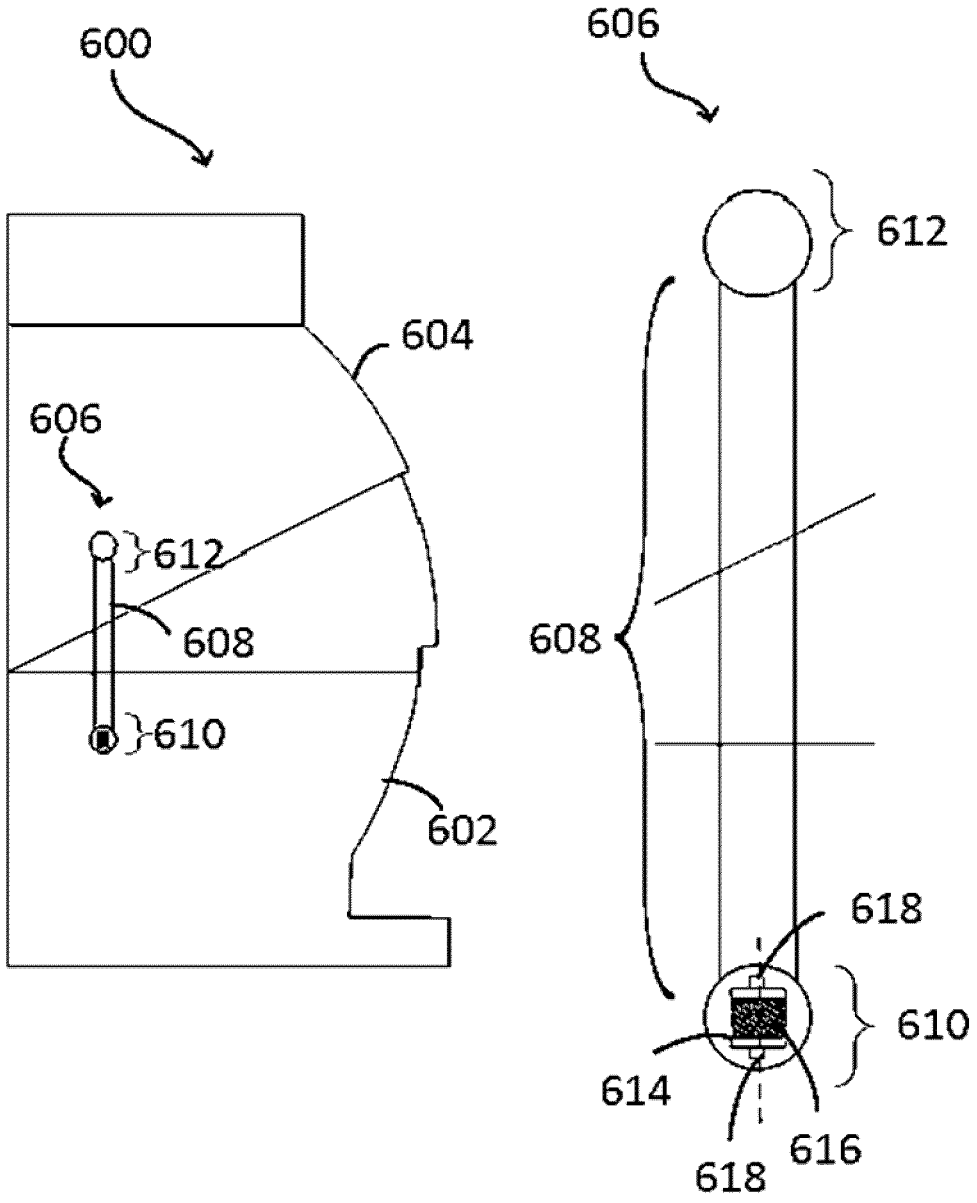
FIG. 6 is a side view of another example of a collapsible toilet enclosure according to the present disclosure showing an enlarged side view of the coupling structure.

FIGS. 5 and 6 illustrate examples of collapsible toilet enclosures according to the present disclosure where the effective length of the linker is adjustable to change the distance between the base portion and the upper frame portion when the linker is engaged with the first and second connecting portions. In the example illustrated in FIG. 5, the linker comprises a slidable member that slidably engages a channel formed by the first and/or second connecting portions. Alternatively, as illustrated in FIG. 6, the linker forms a channel that slidably engages a slidable member of the first and/or second connecting portions. Although FIGS. 5 and 6 illustrate adjusting the effective length of the linker where the support structure engages the base portion of a collapsible toilet enclosure, adjusting the effective length of the linker as presently disclosed may be provided where the support structure engages the upper frame portion, or where the support structure engages both the base portion and the upper frame portion.

FIG. 5 illustrates a collapsible toilet enclosure 500 comprising a base portion 502 and an upper frame portion 504 pivotally connected to the base portion 502 and in the extended position. The collapsible toilet enclosure 500 further comprises a coupling structure 506 comprising a linker 508 and a first connecting portion 510 engaged with the base portion 502 and a second connecting portion 512 engaged with the upper frame portion 504. The linker 508 is engaged with the first connecting portion 510 at a first coupling point 514. The first connection portion 510 forms a channel 516 and the first coupling point 514 functions as a slidable member that is slidably engagable within the channel 516 along an axis of movement (dotted line) to move the coupling point 514 relative to the base portion 502.

FIG. 6 illustrates a collapsible toilet enclosure 600 comprising a base portion 602 and an upper frame portion 604 pivotally connected to the base portion 602 and in the extended position. The collapsible toilet enclosure 600 further comprises a coupling structure 606 comprising a linker 608 and a first connecting portion 610 engaged with the base portion 602 and a second connecting portion 612 engaged with the upper frame portion 604. The linker 608 is engaged with the first connecting portion 610 at a first coupling point 614, which is a channel formed by the walls of the linker 608. The first connecting portion 610 functions as a slidable member 616 that is slidably engagable within the channel 614 along an axis of movement (dotted line) to move the coupling point 614 relative to the base portion 602.

Figure 7:
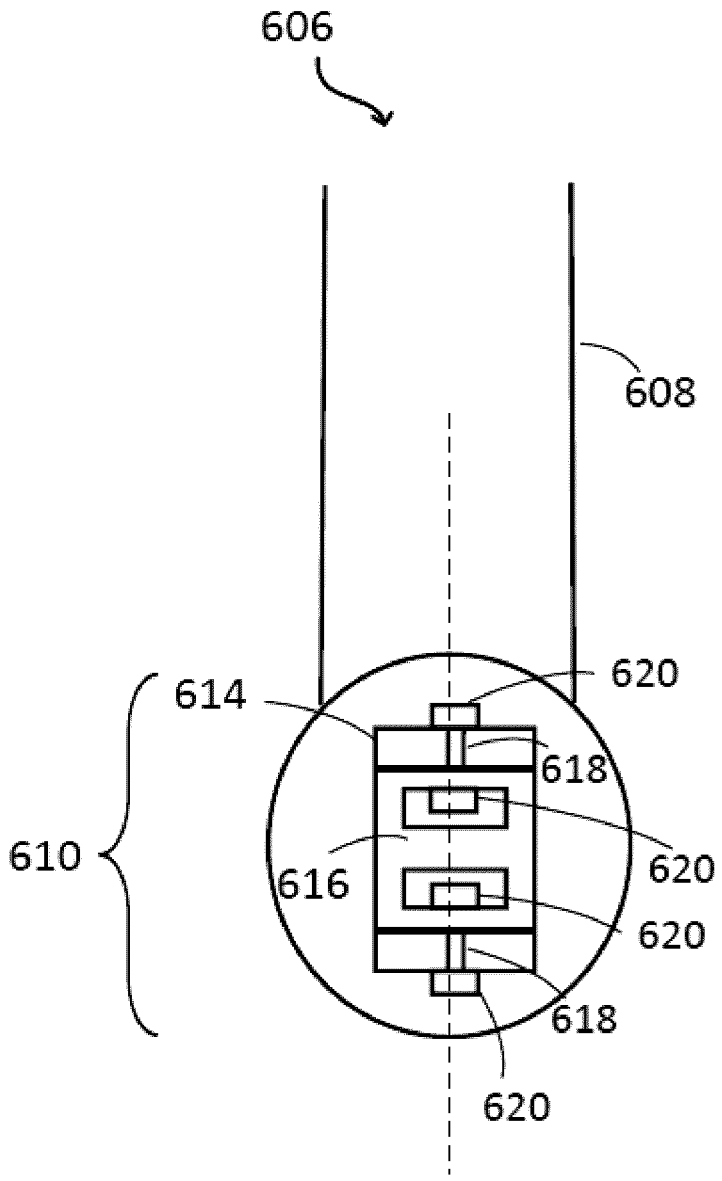
FIG. 7 is a side view of another example of a coupling structure according to the present disclosure.

The collapsible toilet enclosure 600 further comprises an adjusting mechanism to selectively move the first coupling point 614 relative to the base portion 602. As more clearly shown in FIG. 7, the first connecting portion 610 comprises two threaded members 618 that engage the first coupling point 614 and the slidable member 616 to adjust the movement of the first coupling portion 614 relative to the base portion 602. The threaded members 618 engage the coupling point 614 through apertures formed from the sides of the channel 614 along the axis of movement. The threaded members 618 engage the slidable member 616 through apertures formed on the sides of the slidable member 616 that are aligned with the apertures formed from the sides of the channel. The threaded members 618 are securable by nuts 620 that engage both ends of each of the threaded members 618, one of the nuts engaging each of the threaded members 618 on the side of the channel 614 opposite the slidable member 616, and the other of the nuts engaging each of the threaded members 618 on the side of the slidable member 616 opposite the channel 614. In use, a user may rotate the threaded members 618 and/or nuts 620 to move the coupling point 616 relative to the base portion 602. The adjusting mechanism also acts as a locking mechanism to secure the effective length of the linker 608 following adjustment.

Figure 8:
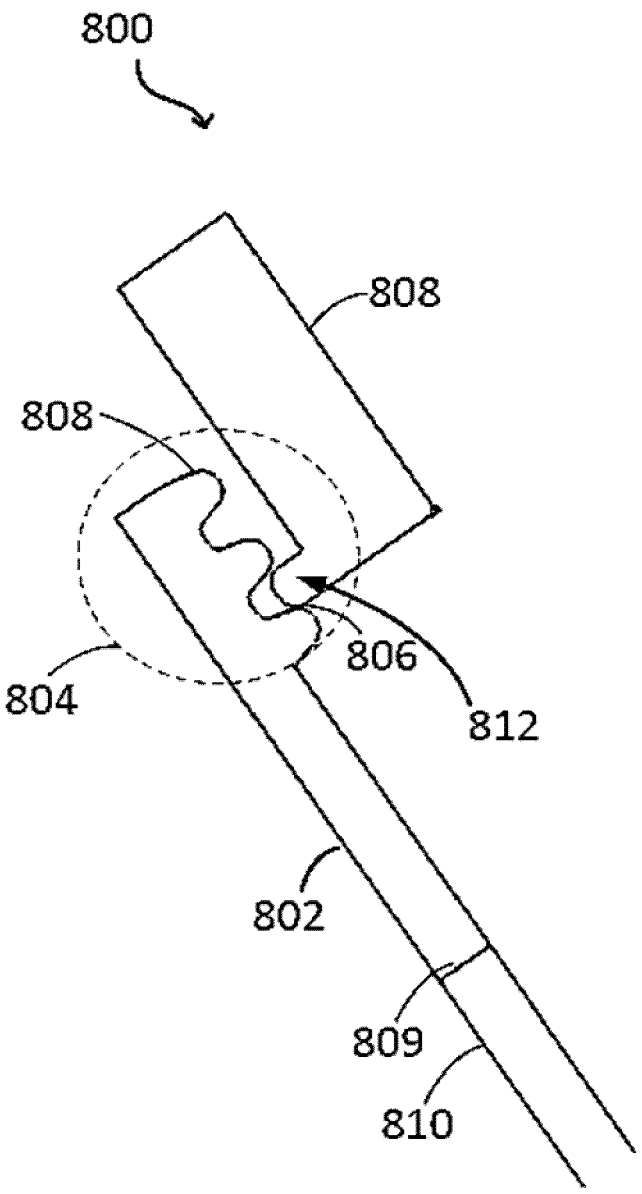
FIG. 8 is a cross-sectional side view of another example of a coupling structure according to the present disclosure.

FIG. 8 illustrates another example of a collapsible toilet enclosure according to the present disclosure where the effective length of the linker is adjustable to change the distance between the base portion and the upper frame portion when the linker is engaged with the first and second connecting portions. The coupling structure 800 comprises a linker 802 that is engagable with the second connecting portion 804 at a second coupling point 806 to engage the upper frame portion 808. The linker 802 is also engaged with the first connection portion 809 by forming a unitary structure with the base portion 810. The linker 802 defines a series of notches 808 and the second connecting portion 804 comprises a protrusion 812 that frictionally engages the linker 802 between a pair of adjacent notches in the series of notches 808. Sufficient force allows the protrusion 812 of the second connecting portion 804 to overcome the frictional engagement between the protrusion 812 and the notches 808 to move the coupling point 806 relative to the upper frame portion 808 along an axis of movement (dotted line). The protrusion 812 may be biased by a spring into a frictionally engaging position with the notches 808.

Figure 9:
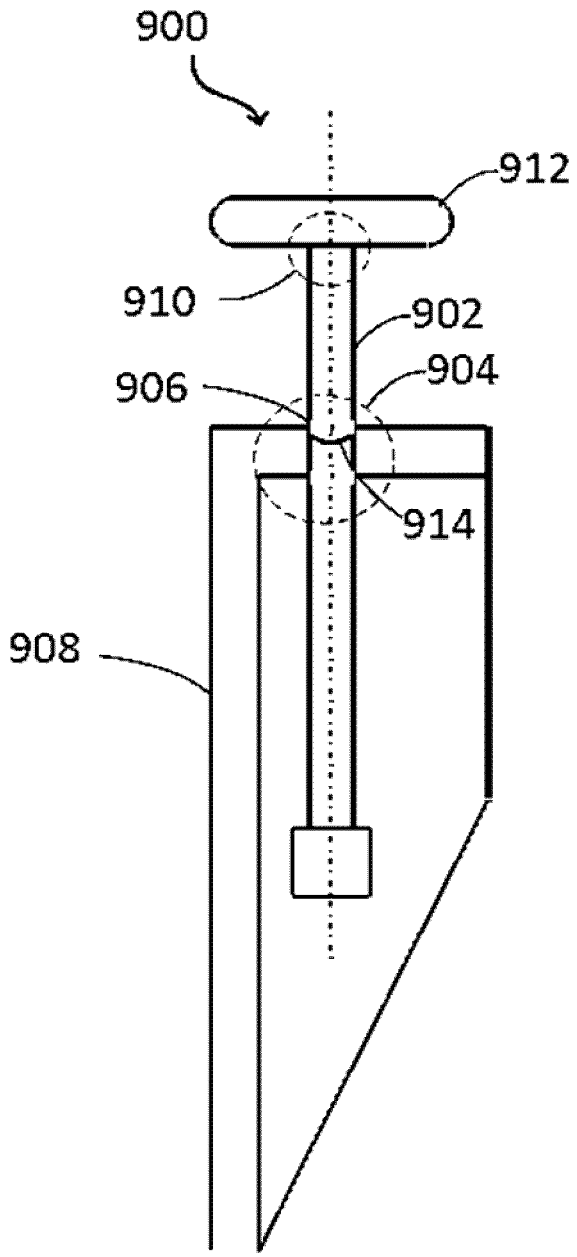
FIG. 9 is a cross-sectional side view of another example of a coupling structure according to the present disclosure.

FIG. 9 illustrates another example of a collapsible toilet enclosure according to the present disclosure where the effective length of the linker is adjustable to change the distance between the base portion and the upper frame portion when the linker is engaged with the first and second connecting portions. The coupling structure 900 comprises a linker 902 that is engagable with the first connecting portion 904 at a first coupling point 906 to engage the base portion 908. The linker 902 is also engaged with the second connecting portion 910 by frictionally abutting a portion of the upper frame portion 912. The linker 902 comprises a protrusion that extends around the circumference of linker 902 in a screw thread-like configuration, and the first connecting portion 904 defines an aperture 914 comprising a protrusion extending around the inner circumference of the aperture 914 in a screw thread-like configuration that is complementary to the screw thread-like configuration of the linker 902. Sufficient rotational force of the linker 902 allows the first coupling point 906 to move relative to the base portion 908 along an axis of movement (dotted line) thereby pushing the upper frame portion 912 to change the distance between the base portion 908 and the upper frame portion 912.

Figure 10:
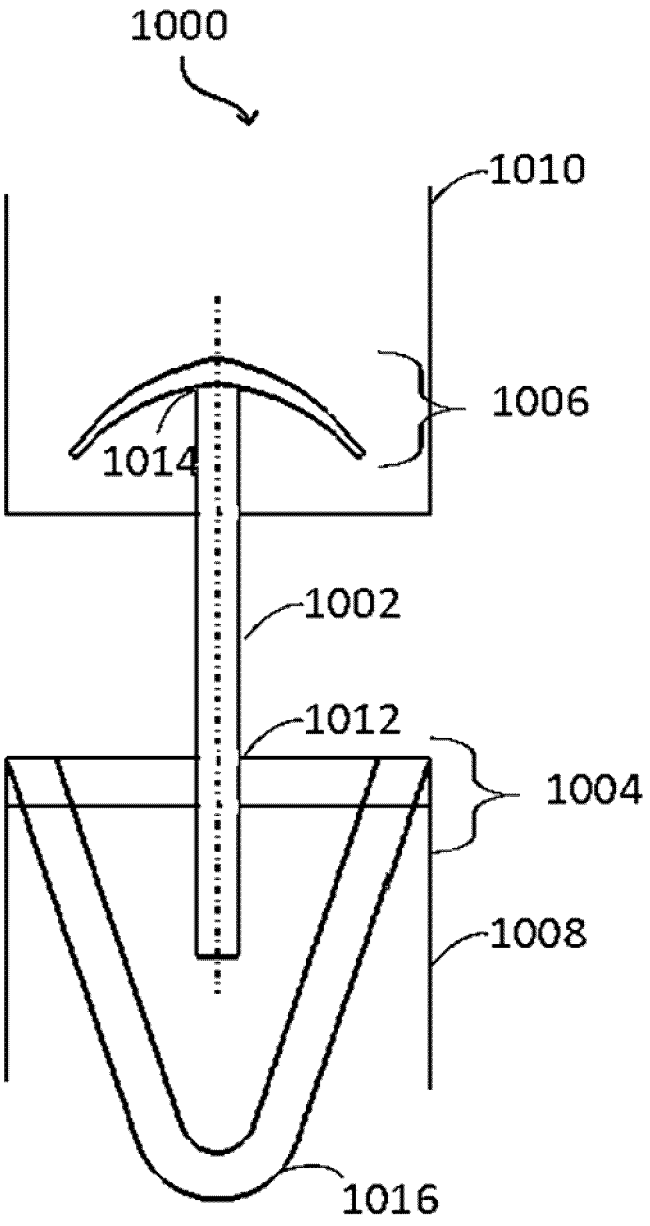
FIG. 10 is a side view of another example of a coupling structure according to the present disclosure.

FIG. 10 illustrates another example of a collapsible toilet enclosure according to the present disclosure where the effective length of the linker is adjustable to change the distance between the base portion and the upper frame portion when the linker is engaged with the first and second connecting portions. The coupling structure 1000 comprises a linker 1002 that is engagable with a first connecting portion 1004 and a second connecting portion 1006 to engage the base portion 1008 and the upper frame portion 1010, respectively. The linker 1002 is engageable with the first connecting portion 1004 at a first coupling point 1012 by thread engagement. The first connecting portion 1004 further comprises a lever 1016. The linker 1002 is also engageable with the second connecting portion 1006 at a second coupling point 1014 by hook-and-loop engagement. The linker 1002, the first connecting portion 1004, and the second connecting portion 1006 together form a toggle latch clasp. In use, when the upper frame portion 1010 is in a collapsed position, the lever of the toggle latch clasp may be released, allowing the release of the linker 1002 from the first and second connecting portions 1004, 1006.

Figure 11:
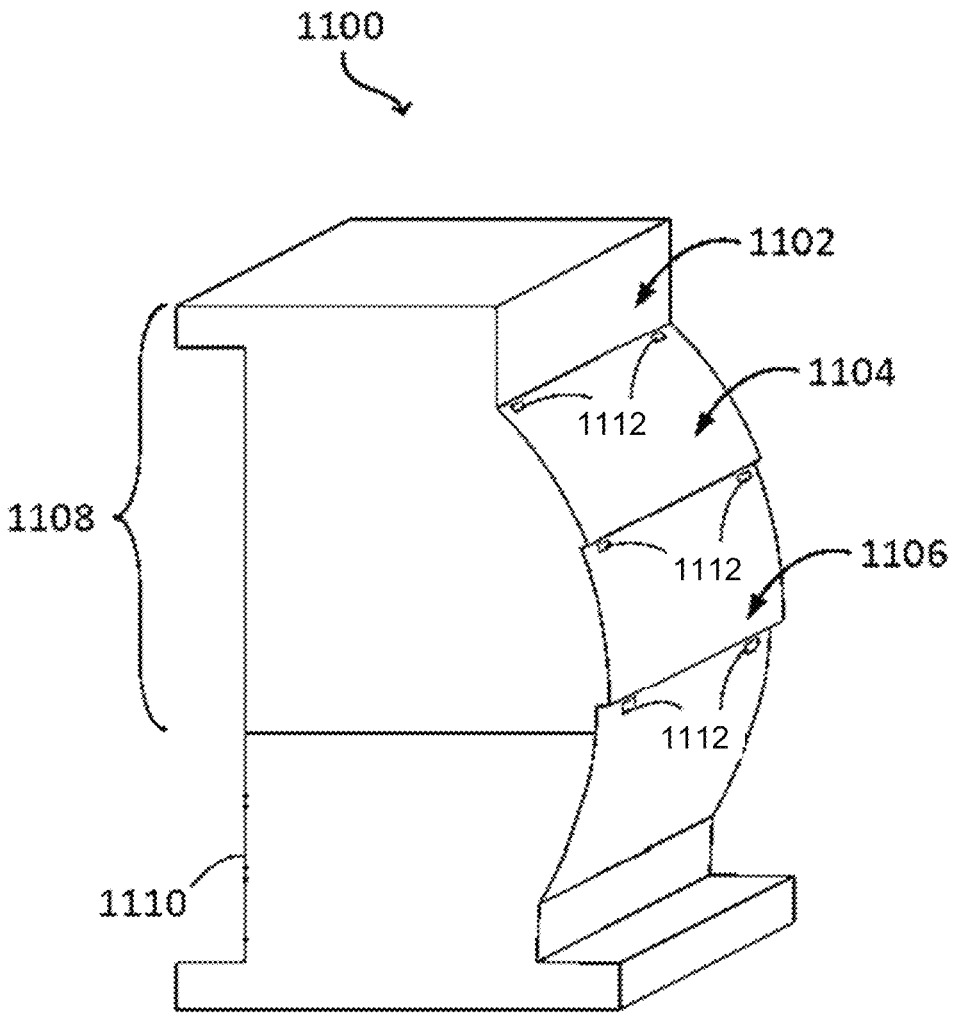
FIG. 11 is a back isometric view of another example of a collapsible toilet enclosure according to the present disclosure in an extended position.

In some examples according to the present disclosure, the upper frame portion of the presently disclosed collapsible toilet enclosures may comprise one or more interconnectable sections that form one continuous roof when the upper frame portion is in the extended position. FIG. 11 illustrates an example of an interconnectable upper frame portion. The collapsible toilet enclosure 1100 comprises a first 1102, a second 1104 and a third 1106 interconnectable section forming a continuous roof when the upper frame portion 1108 is in the extended position. The first, second and third interconnectable sections 1102, 1104, 1106 are pivotally connected to the base portion 1110 and configured to nest with one another when in the collapsed position. In some examples according to the present disclosure, the coupling structures exemplified in FIGS. 8 and 9, are located at junctions 1112 between the first interconnectable section 1102 and the second interconnectable section 1104, between the second interconnectable section 1104 and the third interconnectable section 1106, and between the third interconnectable section 1106 and the base portion 1110. In the extended position, the coupling structures exemplified in FIGS. 8 and 9 function as a physical barrier blocking the first, second and third interconnectable sections 1102, 1104, 1106 from nesting with one another. In use, when a user wishes to move the upper frame portion 1108 into a collapsed position, the user presses down on the linker towards the interior of the upper frame portion, which releases the linker from engaging with the adjacent interconnectable section and allows the first, second, and third interconnectable sections 1102, 1104, and 1106 to nest with each other.

In the preceding description, for purposes of explanation, numerous details are set forth in order to provide a thorough understanding of the examples. However, it will be apparent to one skilled in the art that these specific details are not required. Accordingly, what has been described is merely illustrative of the application of the described examples and numerous modifications and variations are possible in light of the above teachings.

Since the above description provides examples, it will be appreciated that modifications and variations can be effected to the particular examples by those of skill in the art. Accordingly, the scope of the claims should not be limited by the particular examples set forth herein, but should be construed in a manner consistent with the specification as a whole.

The invention claimed is:

1. A collapsible toilet enclosure comprising:

a base portion;

an upper frame portion pivotally connected to the base portion and pivotally movable relative to the base portion between an extended position and a collapsed position; and at least one coupling structure comprising:

a linker, a first connecting portion, and a second connecting portion, wherein the first connecting portion is engaged with the base portion and the second connecting portion is engaged with the upper frame portion, and the linker is engagable with the first and second connecting portions when the upper frame portion is in the extended position and when the upper frame portion is in the collapsed position, the at least one coupling structure being adjustable to change the distance between the base portion and the upper frame portion when the linker is engaged with the first and second connecting portions while the upper frame portion is in the extended position.

2. The collapsible toilet enclosure of claim 1, wherein the length of the linker is adjustable to change the distance between the base portion and the upper frame portion.

3. The collapsible toilet enclosure of claim 2, wherein the linker is an arm.

4. The collapsible toilet enclosure of claim 3, wherein the arm comprises at least two nestable portions movable relative to each other to change the length of the arm.

5. The collapsible toilet enclosure of claim 4, wherein one of the nestable portions defines a channel and the other nestable portion is slidably engagable within the channel along an axis of movement, and the arm further comprises a threaded member to move the nestable portions relative to each other and to change the length of the arm.

6. The collapsible toilet enclosure of claim 5, wherein the threaded member is engagable with the at least two nestable portions along the axis of movement, and rotation of the threaded member moves the nestable portions relative to each other.

7. The collapsible toilet enclosure of claim 2, wherein the linker is a cable.

8. The collapsible toilet enclosure of claim 7, wherein cable comprises at least two cable portions movable relative to each other to change the length of the cable.

9. The collapsible toilet enclosure of claim 8, wherein the linker further comprises a cable tensioner couplable to the at least two cable portions to move the at least two cable portions relative to each other and to change the length of the cable.

10. The collapsible toilet enclosure of claim 1, wherein the first connecting portion, the second connecting portion, or both are adjustable to change the distance between the base portion and the upper frame portion.

11. The collapsible toilet enclosure of claim 10, wherein the linker is releasable from the first connecting portion, the second connecting portion, or both when the upper frame portion is in the collapsed position.

12. The collapsible toilet enclosure of claim 11, wherein the first connecting portion is engagable with the base portion without forming a unity structure, the second connecting portion is engagable with the upper frame portion without forming a unitary structure, or both.

13. The collapsible toilet enclosure of claim 10, wherein:

the linker is engagable with the first connecting portion at a first coupling point, and the first connecting portion is adjustable to move the first coupling point relative to the base portion;

the linker is engagable with the second connecting portion at a second coupling point, and the second connecting portion is adjustable to move the second coupling point relative to the upper frame portion;

or both.

14. The collapsible toilet enclosure of claim 13, wherein first connecting portion defines a channel and the first coupling point is slidably engagable within the channel along an axis of movement, and the first connecting portion further comprises a threaded member to move the first coupling point relative to the base portion.

15. The collapsible toilet enclosure of claim 14, wherein the threaded member is engagable with the channel and the first connecting portion along the axis of movement, and rotation of the threaded member moves the first coupling point relative to the base portion.

16. The collapsible toilet enclosure of claim 13, wherein second connecting portion defines a channel and the second coupling point is slidably engagable within the channel along an axis of movement, and the second connecting portion further comprises a threaded member to move the second coupling point relative to the upper frame portion.

17. The collapsible toilet enclosure of claim 16, wherein the threaded member is engagable with the channel and the second connecting portion along the axis of movement, and rotation of the threaded member moves the second coupling point relative to the upper frame portion.

18. The collapsible toilet enclosure of claim 1, wherein the base portion comprises a first doorframe portion, and the upper frame portion comprises a second doorframe portion, and when the upper frame portion is in the extended position, the first doorframe portion and the second doorframe portion align to form a doorframe, and wherein the distance between the base portion and the upper frame portion is the distance between a corner of the doorframe at the base portion and a corner of the doorframe at the upper frame portion that are adjacent to one another.

* * * * *